United States Patent [19]

Dunn

[11] Patent Number: 5,060,557

[45] Date of Patent: Oct. 29, 1991

[54] SMOKE DAMPER BLADE SEAL

[75] Inventor: James C. Dunn, Bensalem, Pa.

[73] Assignee: Penn Ventilator Company, Inc., Philadelphia, Pa.

[21] Appl. No.: 470,644

[22] Filed: Jan. 26, 1990

[51] Int. Cl.[5] ..... F24F 13/14

[52] U.S. Cl. ..... 98/121.2; 137/601

[58] Field of Search ..... 98/1, 110, /121.2; 137/601

[56] References Cited

U.S. PATENT DOCUMENTS

| | | | |
|---|---|---|---|
| 3,123,098 | 3/1964 | Bishop | 137/601 |
| 3,366,032 | 1/1968 | Alamprese | 98/121.2 |
| 3,447,443 | 6/1969 | Silvey | 137/601 X |
| 3,530,783 | 9/1970 | Alamprese | 98/121.2 X |
| 4,409,990 | 9/1983 | McCabe | 98/121.2 X |
| 4,487,214 | 12/1984 | Tatum | 137/601 X |

*Primary Examiner*—Harold Joyce

[57] ABSTRACT

A smoke damper which includes a rectangular frame and blades mounted in the frame such moveable between a position in which all of the blades are essentially coplanar with adjacent edges of adjacent blades being contiguous one with another, and a position in which the blades are rotated 90 degrees from the previous position with individual blades in planes parallel one with another. At least one of the blades has a recess formed along the length of the blade surface proximate to an edge of the blade and an elastomeric gasket mechanically secured to the edge of the blade having the recess which extends part-way across the recess from the edge of the blade towards the blade central portion. A second blade adjacent to the first blade has an edge along its length extending angularly towards the first blade when the blades are coplanar and the smoke damper is closed, the edge of the second blade being tangent to the elastomeric gasket such that upon the smoke damper being closed and the blades being coplanar, the gasket deforms against the edge of the second blade responsively to air flow directed against the blades towards the recess and entering the recess.

20 Claims, 8 Drawing Sheets

SMOKE DAMPER BLADE SEAL

FIELD OF THE INVENTION

This invention generally relates to heating, ventilating and air-conditioning equipment and specifically relates to blades and blade seals in smoke and fire dampers used in heating, ventilating and air-conditioning air handling equipment.

DESCRIPTION OF THE PRIOR ART

Smoke dampers used in heating, air-conditioning and, especially, ventilating systems are known and generally consist of a frame having a plurality of blades pivotally mounted within the frame and means for moving the blades simultaneously one with another from a position at which the blades are generally parallel with the direction of air flow through the damper to a position at which the blades are generally perpendicular in the direction of air flow through the damper and thereby block most air flow through the damper. Typically, a smoke detector is connected to means for actuating and moving the smoke damper blades. Upon detection of smoke, the smoke damper blades can be moved to a position at which they are perpendicular to the direction of air flow through the damper and, due to overlap of adjacent blades at longitudinally extending edges of the adjacent blades, air flow through the damper is greatly reduced. This reduces the spread of smoke through an air handling system and throughout the building in which the air handling system is installed.

To minimize air flow through a smoke damper, it is desirable to provide seals along the longitudinally contacting or overlapping edges of adjacent blades, to reduce air leakage between the adjacent edges of respective blades when the blades are in the closed position. A number of approaches have been tried to provide such seals. The earliest approach was to merely cause adjacent blades to overlap one another slightly when the damper was in the closed position and to rely upon such overlapping contact of one blade edge on a planar surface of an adjacent blade to provide a seal. Other approaches have included adhesively bonding neoprene gasket material to the blade edges. This use of adhesives with neoprene gasket material has achieved limited success. However, a major disadvantage using neoprene adhesively bonded to a blade edge is that neoprene cannot withstand high temperatures which may be experienced in a building fire. Additionally, the adhesive may give way over time, necessitating replacement of the neoprene gasket material.

Smoke dampers are typically manufactured of galvanized steel.

Another approach to providing a seal between adjacent smoke damper blade edges has been to mechanically secure a second, usually metal, angle member to the galvanized steel blade in order to define a channel at the blade edge for receipt of the neoprene or other elastomeric material for overlapping contact with an adjacent blade edge. This approach facilitates provision of smoke damper blade edge seals resembling windshield wiper blades on an automobile.

While these approaches have met with some success, the need remains for smoke dampers having greater sealing efficacy in order to reduce the spread of smoke throughout buildings in the event of a fire. With recent disastrous fires in buildings, government regulations are increasingly being adopted requiring less and less leakage, i.e. greater and greater sealing, between the blades of smoke dampers. Particularly, the MGM Grand Hotel fire in Las Vegas, Nevada galvanized regulatory authorities. Building codes are being adopted across the country which require ever-lower amounts of leakage through smoke dampers in new building construction.

SUMMARY OF THE INVENTION

In one of its aspects, this invention provides a new smoke damper blade edge seal fabricated of two parts. The smoke damper blade has its edge formed into a particular shape to receive a bayonet-cross-section shaped silicon rubber gasket and to mechanically secure such silicon rubber gasket at the edge of the smoke damper blade. The adjacent edge of an adjacent smoke damper blade, against which the silicon rubber gasket is to form a seal, is formed to contact the blade portion of the bayonet-shaped silicon rubber gasket. A recess, formed in the smoke damper blade in which the bayonet-shaped silicon rubber gasket is secured, is located proximate the edge at which the bayonet-shaped silicon rubber gasket is secured and slightly removed therefrom. The bayonet-shaped silicon rubber gasket is retained by a receptacle formed at the smoke damper blade edge and oriented in a direction such that the longitudinal axis of the handle portion of the bayonet-shaped silicon rubber gasket preferably extends, in the transverse direction respecting the smoke damper blade, preferably in a plane generally parallel with the plane of the smoke damper blade away from the smoke damper blade edge towards the axis about which the smoke damper blade rotates. The recess formed in the smoke damper blade adjacent to the longitudinal edge at which the bayonet-shaped silicon rubber gasket is mechanically secured, has a lip defining juncture of the recess with the central portion of the smoke damper blade. Such lip is located a distance, in the transverse direction, further from the point of securement of the bayonet-shaped silicon rubber gasket to the smoke damper blade edge than the longitudinal length of the bayonet-shaped silicon rubber gasket. Hence, the bayonet-shaped silicon rubber gasket overlies most, but not all, of the recess, with the portion of the recess most adjacent to the lip (at which the recess joins the central portion of the smoke damper blade) being uncovered by the bayonet-shaped silicon rubber gasket. The space between the tip of the bayonet-shaped silicon rubber gasket and the recess lip (defining juncture of the recess with the central portion of the smoke damper blade) defines a mouth which air may enter when the smoke damper blades are in the closed position. In such position, the adjacent edge of the next adjacent blade is proximate to and preferably in tangential contact with the blade portion of the bayonet-shaped silicon rubber gasket. With the smoke damper in the closed position, as air pressure grows, air enters the mouth, between the lip and the extreme tip of the bayonet-shaped silicon rubber gasket and, upon entering this essentially closed reservoir through such mouth, causes the blade portion of the bayonet-shaped silicon rubber gasket to bow or balloon slightly against the adjacent longitudinal edge of the adjacent smoke damper blade. This ballooning forces the flexible blade portion of the bayonet-shaped silicon rubber gasket against the adjacent longitudinal edge of the adjacent smoke damper blade thereby creating a relatively tight seal between the adjacent smoke damper blade longitudinal edges.

DESCRIPTION OF THE PREFERRED EMBODIMENTS

Figure 1:
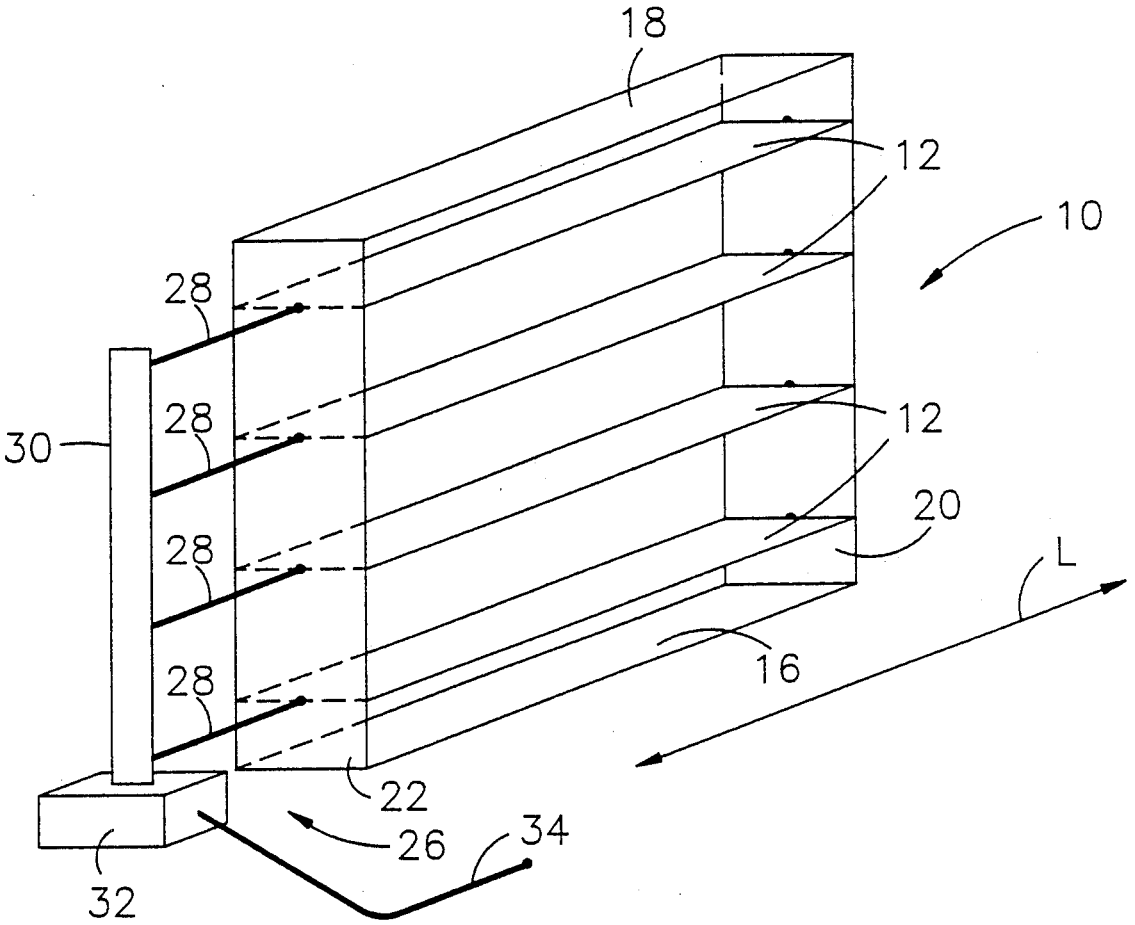
FIG. 1 is a schematic isometric view of a smoke damper to which the invention has applicability, showing the smoke damper in an open position.
Figure 2:
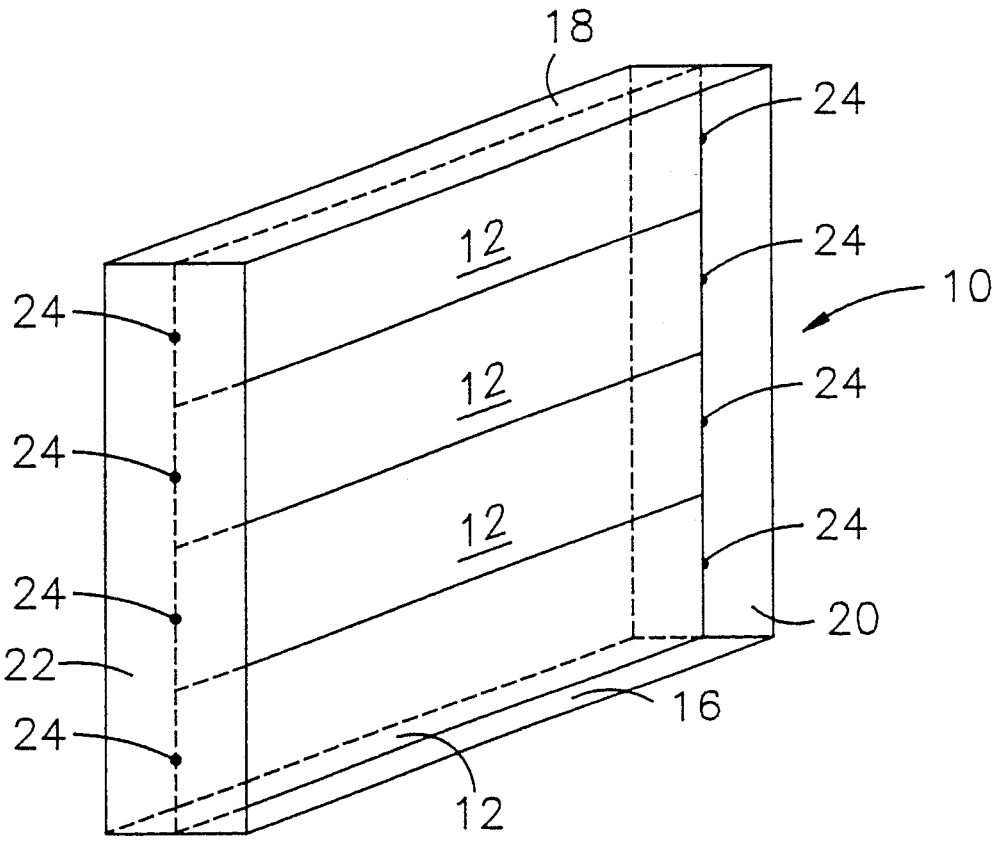
FIG. 2 is a schematic isometric view of a smoke damper to which the invention has applicability, showing the smoke damper in an closed position.

Referring to the drawings in general and to FIGS. 1 and 2 in particular a smoke damper is designated generally 10 and has a base 16, a top 18 and upstanding first and second side frame members 20, 22.

Mounted within smoke damper 10 are a plurality of smoke damper blades designated generally 12. Smoke damper blades 12 are pivotally mounted via suitable bearings or other fittings, which are designated generally 24 and shown only schematically in the drawings, for pivotal rotation of blades 12 respecting first and second side frame members 20, 22. Blades 12 are rotatable about pivotal mounts 24 from a position at which the blades are essentially parallel one with another, illustrated in FIG. 1, defining an "open" position of smoke damper 10, to a position at which blades 12 are substantially co-planar one with another, defining a "closed" position of smoke damper 10, illustrated in FIG. 2.

Conventionally, some means is provided to rotate smoke damper blades 12 to open and to close smoke damper 10 as required; the means for moving smoke damper blades 12 has been illustrated schematically in FIG. 1 and is designated generally 26. As illustrated schematically in FIG. 1, means 26 for moving smoke damper blades 12 includes a plurality of shafts 28 connected to blades 12 via pivotal mounts 24. Shafts 28 are rotated by a suitable chain, designated generally 30 and shown only schematically in FIG. 1. Chain 30 is driven along a track of suitable shape and size by a motor designated schematically 32 in FIG. 1. Motor 32 may be actuated by a smoke sensor or detector illustrated schematically and designated 34 in FIG. 1.

All of the above-described structure, as illustrated in FIGS. 1 and 2, is conventional and well-known in the art. Typically, smoke dampers as designated generally 10 are constructed of galvanized steel, to be rugged and to withstand high temperature environments as may be experienced when fires break out.

Smoke dampers of the type designated generally 10 are installed within heating, ventilating and air-conditioning ducts in buildings to prevent the spread of smoke throughout a building when a fire breaks out. Typically, smoke detector 34 detects presence of smoke, actuates motor 32 and causes smoke damper 10 to close, with blades 12 moving from the position illustrated in FIG. 1 to the position illustrated in FIG. 2.

Figure 3:
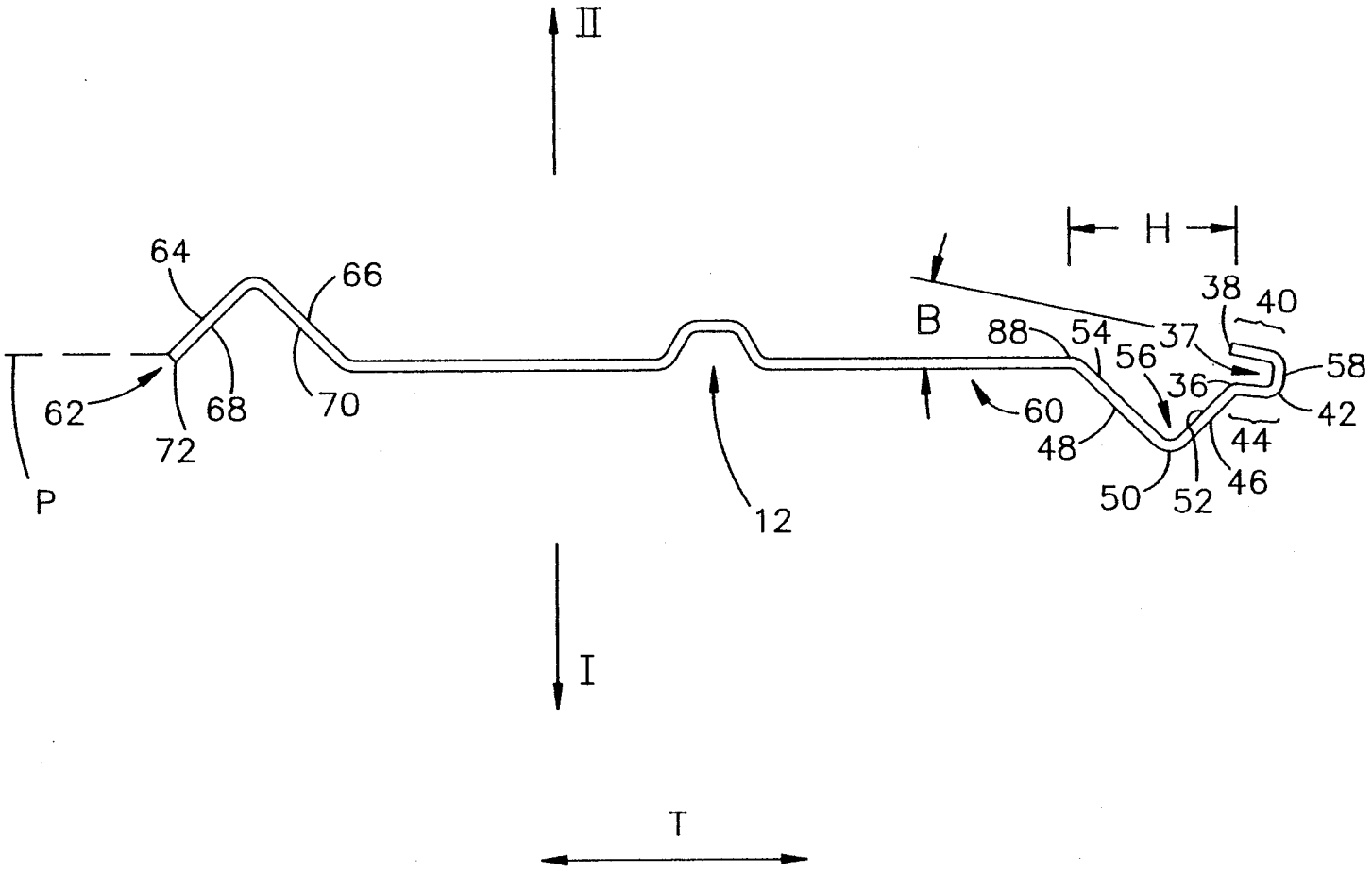
FIG. 3 is a sectional view of a smoke damper blade embodying aspects of the invention.

FIG. 3 illustrates a smoke damper blade 12, in section. In this regard, in FIG. 1, directional arrow L indicates the longitudinal direction respecting a smoke damper blade 12. The transverse section illustrated in FIG. 3 is, of course, taken perpendicularly to the longitudinal direction illustrated in FIG. 1 and indicated by arrow L. Sectioning lines have been omitted from FIG. 3 to aid drawing clarity.

Still referring to FIG. 3, a smoke damper blade designated generally 12 has, at its right-hand edge illustrated in FIG. 3, a receptacle formed therein where the receptacle is designated generally 37 and is formed in a shape so that the open mouth portion 36 of receptacle 37 faces generally along the plane within which the major portion of smoke damper blade 12 substantially lies. When mouth 36 and receptacle 37 are fabricated by bending one of the ends of blade 12, one of the longitudinal extremities of blade 12 into the shape shown generally in FIG. 3, the mouth is positioned so that it opens at an angle of about 12 degrees to the plane within which blade 12 generally lies. This angle is designated generally B in FIG. 3.

The end of blade 12 at which mouth 36 is formed includes a longitudinally extending blade transverse tip 38, a shortened straight portion indicated generally by bracket 40, a curved portion defining a closed bottom of mouth 36 where this closed bottom is denoted generally 42, a second generally straight, shortened portion indicated generally by bracket 44 and two straight portions 46, 48 positioned substantially at right angles to each other and connected via bend 50.

The concave surface portion of blade 12 defined by inwardly facing surfaces 52 and 54 of straight portions 46, 48 respectively defines a recess designated generally 56 in FIG. 3 which is proximate to but slightly inwardly removed from the longitudinally extending transverse extremity of blade 12 which is closest to the right-hand side of the paper in FIG. 3; this transverse extremity is numbered 58 in FIG. 3. Recess 56, particularly straight portion 48 forming a bottom portion thereof, joins the central portion of blade 12, which central portion is designated generally 60 in FIG. 3.

At a second, opposite longitudinally extending transverse extremity designated generally 62 in FIG. 3, blade 12 is bent to have two sections 64, 66 preferably disposed generally at right angles respecting one another. Inwardly facing surfaces of bent portions 64, 66 are numbered 68, 70 in FIG. 3 while the longitudinally extending, transversely extreme left-hand facing end surface of blade 12 is numbered 72 in FIG. 3. Surface 72 is preferably substantially perpendicular to surface 68 and, therefore, substantially parallel with surface 70. Surfaces 68, 70 are formed by bending blade 12 and are formed from a surface portion of blade 12 which faces generally in the direction indicated by arrow I in FIG. 3 while surfaces 52, 54 and the surfaces defining the inner portion of receptacle 37 are formed generally of a larger surface portion of blade 12 which faces generally in the direction of arrow II in FIG. 3. Bent portions, 64, 66 are preferably of substantially the same length so that longitudinally extending transverse tip 72 of blade 12 lies generally in the plane in which the major portion of blade 12 lies. This plane is indicated generally by dotted line P in FIG. 3; the geometry is also clearly illustrated in FIG. 6.

Figure 5:
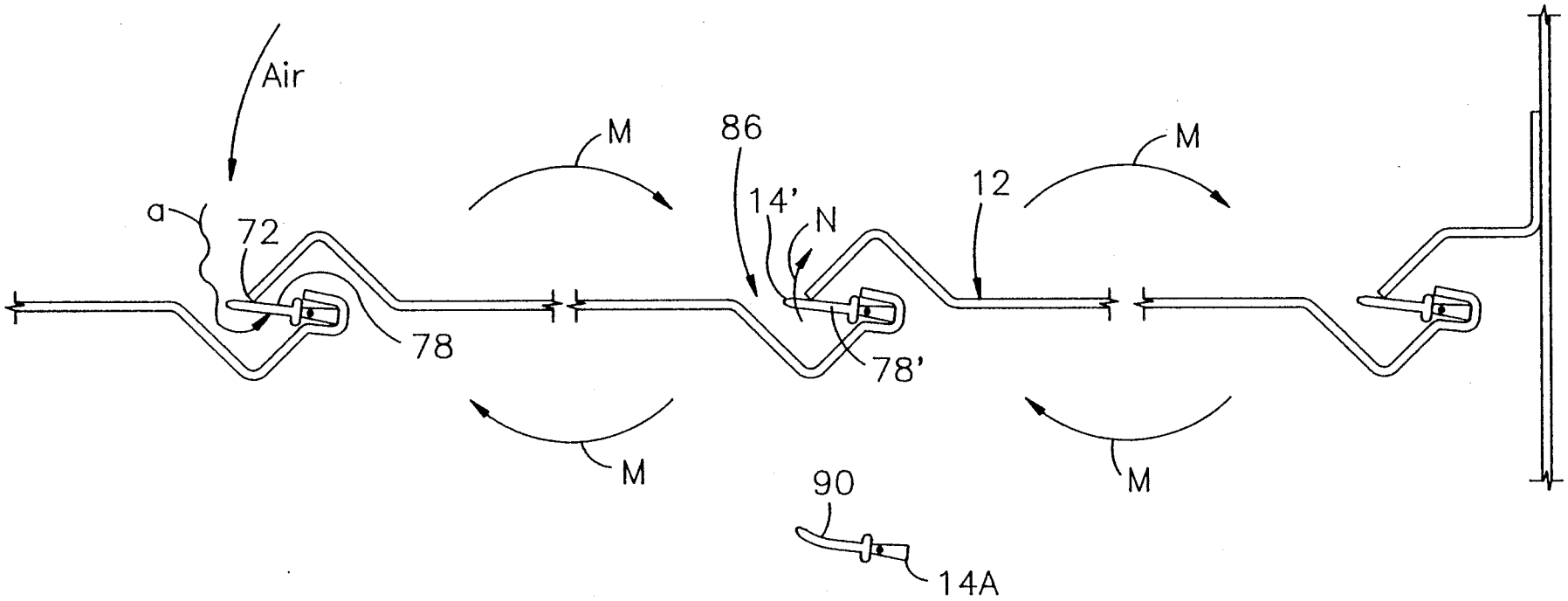
FIG. 5 is a sectional view of a smoke damper blade-gasket assembly showing the manner in which adjacent smoke damper blade-gasket assemblies provide the seal of the invention.

Portions 46, 48 are bent in a manner that portion 48 is preferably slightly longer than is portion 46. This geometry and fabrication is desirable so that the center line of receptacle 37 is essentially within plane P when a bayonet-shaped gasket is inserted into receptacle 37 and shortened portion 40 is bent in a manner to reduce angle B from approximately 12 degrees to 0 degrees, thereby clamping the bayonet-shaped gasket within receptacle 37. The shortened length of portion 46 relative to portion 48 results in receptacle 37, when closed about the bayonet-shaped gasket, aligning the gasket essentially in plane P. This is illustrated in FIG. 5.

Figure 4:
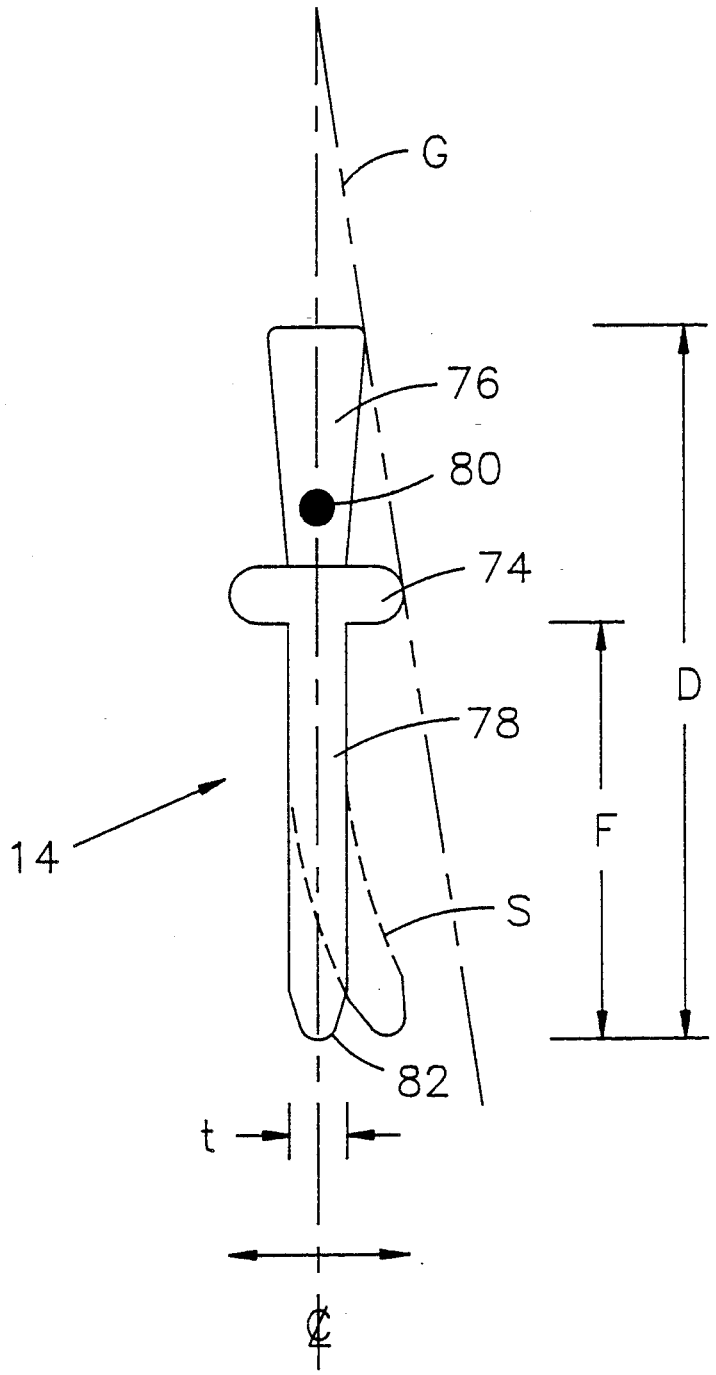
FIG. 4 is a plan view of a smoke damper blade gasket manifesting aspects of the invention.
Figure 8:
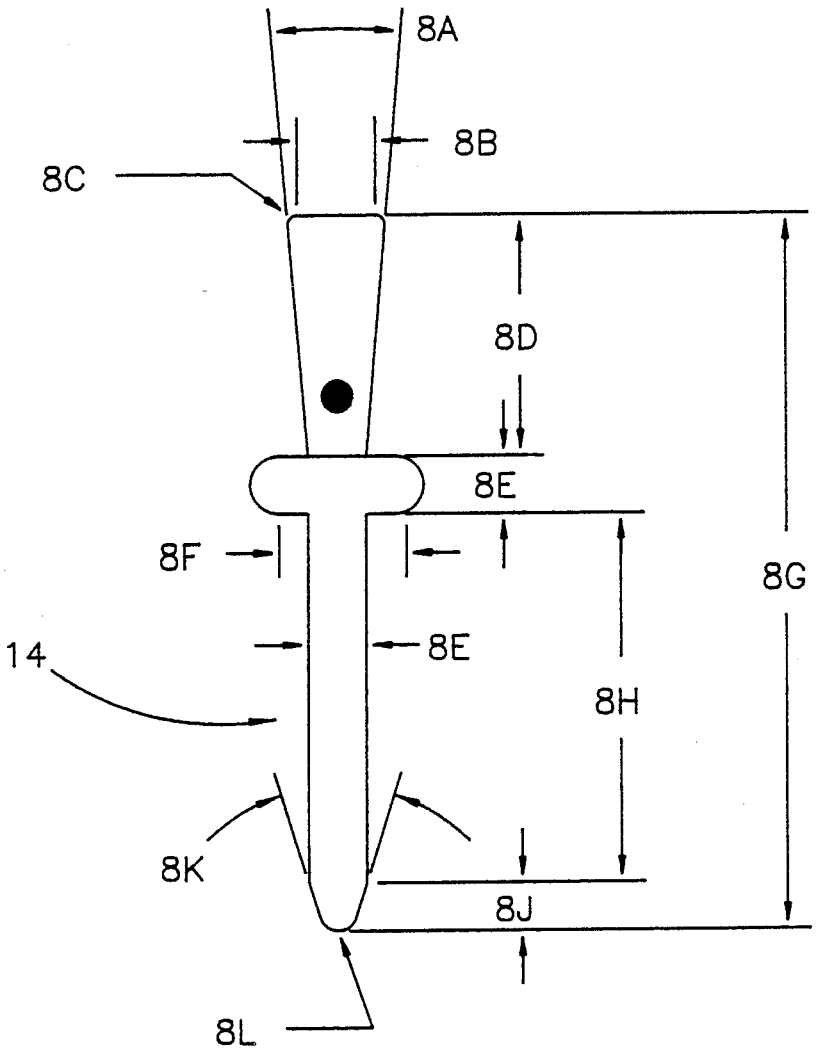
FIG. 8 is a sectional view of the smoke damper blade gasket, similar to that of FIG. 4, illustrating the geometry and dimensions, in inches, for the smoke damper blade gasket in the preferred embodiment of the invention.

Referring to FIG. 4, the bayonet-shaped gasket is designated generally 14. Gasket 14 includes a hilt 74, a handle 76 and a saber portion 78. Gasket 14 is preferably silicon rubber, to withstand high temperature environments in fire conditions. Saber portion 78 is sufficiently thin in dimension, as designated by double-ended arrow T in FIG. 4, to flex in response to relatively light air pressures and resulting forces. In the preferred embodiment of the invention, saber portion 78 has thickness indicated generally by dimension t of 0.062 inches, as illustrated in FIG. 8. In the preferred embodiment of the invention, gasket 14 further includes a cord member 80, preferably manufactured of Kevlar, a high strength polyamide material manufactured by DuPont, of about 0.025 inches diameter; gasket 14 is extruded with cord 80 in place. In the preferred embodiment of the invention, gasket 14 is preferably about ¾ of an inch in length; this is indicated by dimension D in FIG. 4. Saber portion 78 is preferably about 0.42 inches in length and has a rounded, slightly tapered tip as indicated by 82 in FIG. 4.

Still referring principally to FIG. 4, gasket 14 when extruded has the shape substantially as illustrated in solid lines in FIG. 4. However, because the rubber is warm when it emerges from the extruder and the gasket is on its side when conveyed away from the extruder head to cool, resting on planar surface of the conveyor designated generally by the line G in FIG. 4, as gasket 14 cools, it assumes a shape or a set as indicated by dotted line S in FIG. 4 whereby the tip portion 82 of gasket 14 is no longer aligned with the gasket center line but is displaced therefrom, as illustrated in dotted lines in FIG. 4. This is advantageous to the seal of the invention, as described below.

The surface of the conveyor carrying gasket 14 after gasket 14 exits the die, and on which gasket 14 lies as it cools is designated schematically by line G in FIG. 4.

FIG. 5 illustrates three separate gaskets 14 installed in receptacles 37 of blades 12 in a smoke damper according to the invention. Smoke damper blades 12 have been broken for purposes of clarity in the drawing. FIG. 5 illustrates a portion of the smoke damper of the invention in the closed position, as represented generally by the smoke damper illustrated in FIG. 2. To open the smoke damper, blades 12 are rotated in the directions indicated by arrows M in FIG. 5.

As illustrated in FIG. 5, bayonet-shaped gaskets 14 are secured within receptacles 37 of blades 12 by having shortened portions 38 bent against handle portions 76 of gaskets 14, to reduce angle B in FIG. 3 from the approximate 12 degrees at which blade 12 is fabricated to 0 degrees. With this construction and the geometry of receptacle 37 and the end of blade 12 illustrated in detail in FIGS. 3, 6 and 7, bayonet-shaped gasket 14 assumes the position at which its center line (without deformation or any "set") is essentially within the plane P of the major portion of blade 12. This is illustrated in FIG. 5.

As depicted generally at the center of FIG. 5, bayonet-shaped gasket 14' is positioned so that its saber 78' is essentially coplanar with the major portion of blade 12. Blade 14 is configured such that the length of saber portion 78, indicated generally by dimensional arrows F in FIG. 4, is slightly shorter than the distance, illustrated by dimensional arrows H in FIG. 3, from the beginning of recess 56 (which is defined by juncture of central portion 60 of blade 12 and straight portion 48) to blade tip 38. Because distance F, namely the length of saber portion 78 of gasket 14, is slightly less than distance H, namely the transversely extending length of longitudinally extending recess 84 in FIG. 3, a slight gap or mouth, indicated generally 86 at the central portion of FIG. 5, results between tip 82 of gasket 14 and juncture of straight portion 48 and central portion 60 where such juncture has been designated generally as vertex 88 in FIG. 3. This is also apparent from FIGS. 6 and 8.

Presence of mouth 86 permits air, moving in the direction indicated by the arrow labeled "Air" in FIG. 5, to enter mouth 86 as generally illustrated by the curly arrow "a" in FIG. 5. As the air encounters surfaces 52 and 54 defining recess 56, force from the air results against saber 78 of gasket 14, as indicated by curly arrow "a" in FIG. 5. This causes saber portion 78 of gasket 14 to deflect or to balloon slightly, moving into contact with tip 72, or more tightly contacting tip 72 if saber portion 78 and tip 72 are already in the preferred tangential contact one with another. The movement of saber portion 78 of gasket 14 may manifest itself as some rotational movement of tip 82 of saber portion 78 relative to hilt 74 of gasket 14, about an apparent center located in the vicinity of juncture of saber portion 78 and hilt 74 of gasket 14. Such rotational movement is indicated schematically by arrow N in FIG. 5.

In any event, action of air filling recess 56 causes this bowing, ballooning, rotation or deflection of saber portion 78 with saber portion 78 moving against tip 72, creating a tight seal at the point of contact between saber 78 and tip 72 when two adjacent blades 12 of smoke damper 10 are positioned as illustrated in FIG. 5, with their most adjacent longitudinally extending transverse extremities or edges substantially contiguous one with another.

The property of the bayonet-shaped gasket whereby it may be provided with a slight set or bend as illustrated generally in dotted lines in FIG. 4 may be advantageously used to enhance performance of the seal of the invention. When the bayonet is provided in the bowed or set disposition, it is installed in a position, relative to the smoke damper blades 12, as illustrated generally by bayonet-shaped gasket portion 14A in FIG. 5. This is so that the concave surface 90 of saber portion 78 of gasket 14A may contact a respective tip portion 72; such contact between a concave gasket surface and a damper blade tip provides an even better seal than contact between a straight or planar surface of the bayonet-shaped gasket 14 and a blade tip 72.

In the preferred embodiment of the invention, blade 12 may be fabricated of 16 gauge galvanized steel.

In fabricating the invention, when the bayonet-shaped gasket is inserted into receptacle 37 and shortened portion 40 is bent to secure gasket 14, shortened portion 40 need only be bent sufficiently to clamp around the handle portion of bayonet-shaped gasket 14 to retain it in place.

Because the seal of the invention is fabricated without use of adhesives, no maintenance or replacement of the seal or the gasket is required.

Smoke dampers according to the invention, when tested, have exhibited substantially improved performance characteristics over smoke dampers known heretofore.

One important criteria for evaluating a smoke damper is the AMCA (Air Movement and Control Association) specification for damper air leakage. A smoke damper is considered to be a Class 1 smoke damper if it provides leakage of 8 or less cubic feet of air per minute, per square foot of smoke damper, at a pressure differential of 4 inches of water across the smoke damper. Similarly, a smoke damper is considered to be a Class 2 smoke damper if it provides leakage of 20 or less cubic feet of air per minute per square foot of smoke damper, at a pressure differential of 4 inches of water across the smoke damper.

Prior art smoke dampers, utilizing the various seals described above in the discussion of the prior art, meet the Class 2 specification criteria. However, smoke dampers manifesting the invention meet the Class 1 specification criteria.

During tests, smoke dampers according to the invention have been exposed to high temperature environments of 350 degrees Fahrenheit for 30 minutes. When tested after being exposed to such high temperatures, smoke dampers according to the invention have performed without degradation of their seals. In other words, the smoke dampers performed as well, with respect to minimizing air flow through the damper when in the closed position, after being exposed to the high temperature as before being exposed to the high temperature.

In life testing, smoke dampers according to the invention have been tested for over one million cycles of opening and closing without any degradation in performance of the damper; smoke dampers according to the invention have still met the AMCA Class 1 specification after one million cycles of testing.

Silicon rubber is the preferred material for gasket 14. Silicon rubber is a necessity for use in fire environments because of silicon rubber's resistance to high temperatures. Note that prior to the invention, it has not been generally possible to use silicon rubber as a gasket material for a smoke or fire damper because silicon rubber could not be glued or secured by other adhesives to galvanized steel smoke damper blades. However when utilizing mechanical fixation resulting from the geometry according to the invention, silicon rubber performs admirably.

Smoke dampers according to the invention have been exposed to falling water and have, surprisingly, been found to provide water-tight seals when the water has been applied to the smoke damper of the invention in the direction indicated by the arrow "Air" in FIG. 5.

In one test of a smoke damper according to the invention having blades 8 inches wide in the transverse direction, the smoke damper according to the invention permitted only two and one-half cubic feet per minute of air leakage per square foot of smoke damper at a differential pressure of four inches of water across the smoke damper.

The smoke damper seal of the invention is designed so that point or line contact results between the saber portion of gasket 14 and tip 72 of blade 12 when the blades are closed and no air pressure differential exists across the damper. The ballooning effect when air pressure deflects or deforms saber portion 78 of gasket 14 against tip 72 is the principal factor producing the seal. Due to dimensional variations, which are unavoidable in the manufacturing process, the desired point or line contact between saber portion 78 of gasket 14 and tip 72 of blade 12 sometimes does not result. Even in such circumstances, the seal of the invention functions adequately. Hence, there is a certain amount of built-in tolerance for error in the seal design according to the invention.

When air flow is in the direction opposite to that indicated by the arrow "Air" in FIG. 5, while this is not the direction of airflow for which the invention seal is primarily designed, the invention seal nevertheless results in an AMCA Class 2 smoke damper.

Another advantage provided by the invention is that in the configuration illustrated in FIG. 5, the invention provides a fire damper as well as a smoke damper. (A fire damper is one in which there is no "see through" when the gasket or other material at the juncture of contiguous damper blades burns away in a fire.)

Due to the good performance of smoke dampers embodying the invention when air flows in either direction, smoke dampers according to the invention have increased flexibility over those known heretofore.

Because gasket 14A is preferably provided in the curved, deformed condition when installed in receptacle 37, when the smoke damper is closed contact of tip 72 against saber portion 78 deforms the rubber material of saber portion 78 back to an essentially straight condition as manifested by the assembly shown in FIG. 5.

Cord 80 is provided as a portion of gasket 14 to prevent gasket 14 from stretching during installation in blade 12.

FIG. 5 at its right-hand side illustrates a seal according to the invention where the gasket contacts a stationary angular member 92 affixed to a portion of the frame of the smoke damper.

In the preferred embodiment of the invention, blade portions 46 and 48 are at substantially right angles one to another and are each at 45 degree angles to the plane of the major portion of the blade, indicated as P in FIG. 3. Additionally, blade portions 64, 66 are preferably at right angles one to another and also at 45 degree angles to plane P. In the preferred embodiment of the invention, blade portion 66 has been about 0.68 inches in length while blade portion 64 has been about 0.616 inches in length. This results in the unnumbered right angle corner defining juncture of the surface of tip 72 with surface 68 being aligned with the surface of central portion 60 of blade 12 which faces in the direction of II in FIG. 3. These details are also shown in FIG. 6.

Further respecting the preferred embodiment of the invention, short portions 40, 44 have preferably been parallel one to another and have each been about 0.3 inches in length. Receptacle 37 has had transverse width of about 0.14 inches while handle portion 76 of gasket 14 has had width of about 0.10 inches at its position of maximum width remote from the hilt portion of gasket 14; handle portion 76 has tapered at an angle of about 14 ½ degrees from its position of maximum width to contact with hilt 74. Complete dimensional details of the blade and gasket portions of the preferred embodiment of the invention are set forth in FIGS. 6, 7 and 8 which illustrate the geometry of the preferred embodiment of the invention.

Figure 6:
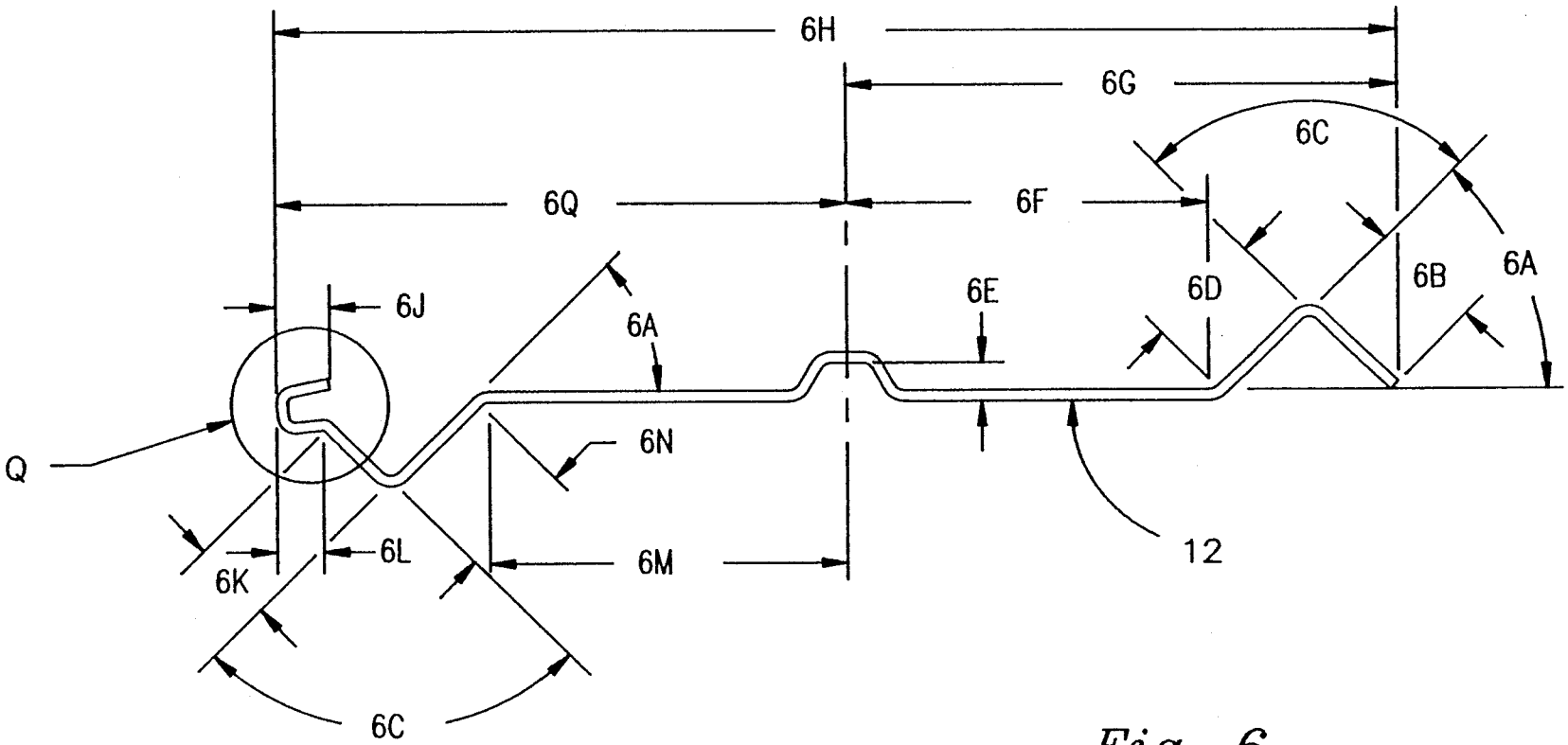
FIG. 6 is a sectional view of a smoke damper blade, similar to that of FIG. 3, illustrating the geometry and dimensions, in inches, for the smoke damper blade in the preferred embodiment of the invention.
Figure 7:
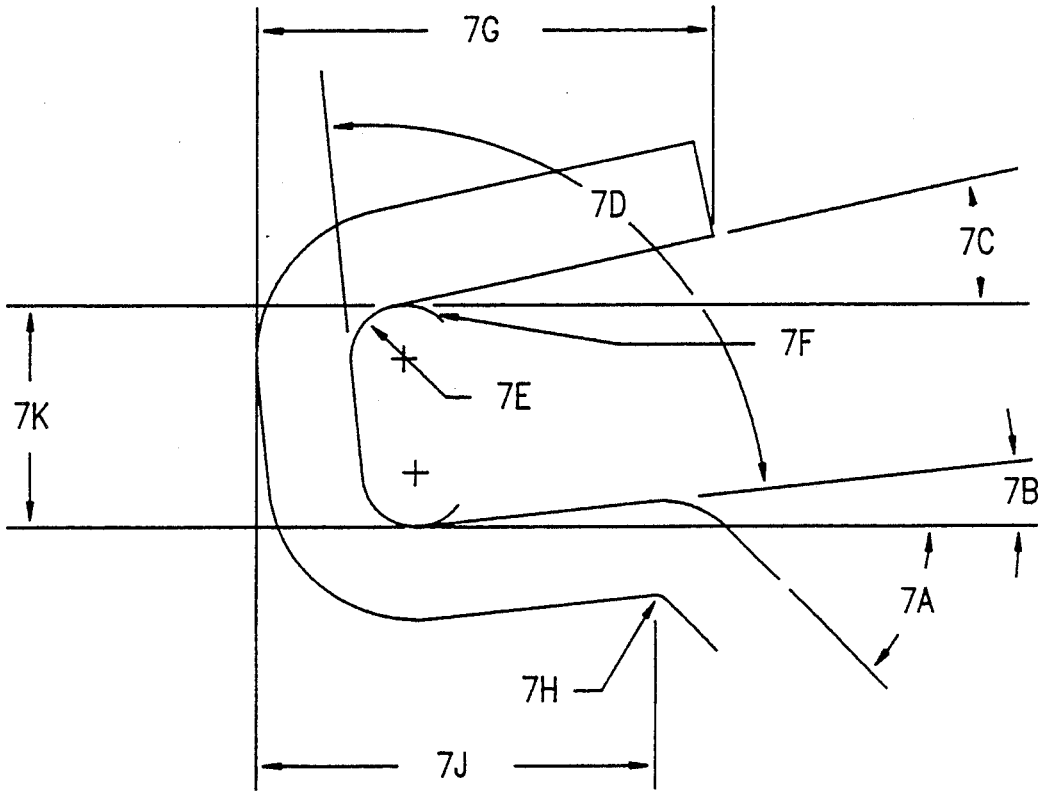
FIG. 7 is an enlarged view of the portion of the structure illustrated in FIG. 6 within the circle identified by the circle Q in FIG. 6, illustrating certain geometry and dimensions, in inches, for a portion of the smoke damper blade in the preferred embodiment of the invention.

The following table correlates the letter codes given in FIGS. 6, 7 and 8 to the dimensional details of the preferred embodiment of the invention:

FIG. 6

| Letter | Measurement |
|---|---|
| 6A | 45.000° |
| 6B | .618 inches |
| 6D | .660 inches |
| 6E | .217 inches |
| 6F | 2.033 inches |
| 6G | 3.040 inches |
| 6H | 6.235 inches |
| 6J | .302 inches |
| 6K | .456 inches |
| 6L | .268 inches |
| 6M | 2.034 inches |
| 6N | .680 inches |
| 6P | 6.000° |
| 6Q | 3.195 inches |

FIG. 7

| Letter | Measurement |
|---|---|
| 7A | 45.000° |
| 7B | 6.000° |
| 7C | 12.000° |
| 7D | 90.000° |
| 7E | .035R Typ Plcs |
| 7F | Tangent Typ 2 Plcs |
| 7G | .302 |
| 7H | .010R |
| 7J | .268 inches |
| 7K | .140 (+.010) (−.000) |

FIG. 8

| Letter | Measurement |
|---|---|
| 8A | 14.588° |
| 8B | .102 inches |
| 8C | .010R |
| 8D | .250 inches |
| 8E | .125 inches |
| 8G | .750 inches |
| 8H | .389 inches |
| 8J | .049 inches |
| 8K | 35.321° |
| 8L | .016R |

I claim the following:

1. A smoke damper comprising:

a. a rectangular frame;

b. a plurality of blades pivotally mounted in said frame, said blades being moveable between a position at which all of said blades are essentially coplanar with adjacent edges of adjacent blades being substantially contiguous one with another, and a position at which said blades are rotated substantially 90 degrees from said previous position with individual ones of said blades in planes parallel one with another;

c. means for moving said blades between said two positions;

d. means for detecting presence of smoke and actuating said blade movement means;

e. at least one of said blades having a longitudinally extending recess formed in the blade surface proximate to a longitudinally extending edge of said blade but transversely removed from said longitudinally extending edge;

f. elastomeric gasket mechanically secured to the longitudinal edge of said blade having said recess, extending part-way across said recess from said longitudinal edge of said blade towards the blade central portion;

g. a second blade adjacent said first blade having a longitudinal edge extending angularly towards said first blade longitudinal edge when said blades are substantially coplanar and said smoke damper is closed, said transversely extending longitudinal edge of said second blade being substantially tangent to said elastomeric gasket member and sufficiently far from either end of said gasket member that upon said smoke damper being closed and said blades being substantially coplanar, said gasket deforms against said longitudinal edge of said second blade responsively to air directed against said blades in a direction facing said recess and entering said recess.

2. The damper of claim 1 wherein said gasket is secured to said blade by a portion of said blade being crimped against said gasket.

3. The damper of claim 2 wherein said crimped portion of said blade is at the blade longitudinal edge extremity.

4. The damper of claim 1 wherein said recess is generally V-shaped.

5. The damper of claim 1 wherein said gasket is curved when in a relaxed position.

6. The damper of claim 5 wherein said gasket is concave in a direction away from said recess.

7. The damper of claim 1 wherein said transversely extending longitudinal edge of said second blade is the extremity of one leg of a V-shape, remote from the vertex of the V, said V-shape being formed in said blade and facing oppositely from said recess.

8. The damper of claim 2 wherein said crimped portion of said blade and said gasket retained therein substantially cover the mouth of said recess formed in said blade.

9. The damper of claim 1 wherein said gasket is silicon rubber.

10. The damper of claim 4 wherein said V-shape has about a 90 degree vertex.

11. The damper of claim 1 wherein position of mechanical securement of said gasket to said blade is at a longitudinal edge of said blade and transversely separated from a remaining portion of said blade by said recess, said gasket being of lesser length in the transverse direction that distance by which said recess separates said position of mechanical securement from said remaining portion of said blade.

12. The damper of claim 11 wherein said gasket is concave in a direction away from said recess.

13. The damper of claim 12 wherein said recess is generally V-shaped.

14. The damper of claim 13 wherein said transversely extending longitudinal edge of said second blade is the extremity of one leg of a second V-shape, remote from the vertex of the second V, said second V-shaped being formed in said blade and facing oppositely from said recess.

15. The damper of claim 14 wherein said extremity of one leg of said second V-shape, remote from the vertex of said second V, defining said transversely longitudinal edge of said second blade is substantially co-planar with a major portion of said second blade.

16. A damper comprising:

a. a frame;

b. a plurality of members pivotally mounted in said frame, for unitary movement between a position at which edges of adjacent members are substantially contiguous and a position at which individual members are in parallel planes;

c. means for moving said members between said positions;

d. longitudinal recesses present in the members proximate longitudinal edges;

e. flexible sealing means secured to said longitudinal edges, extending across said recesses from said longitudinal edges;

f. second members adjacent first members each having a longitudinal edge extending toward said first member longitudinal edge when said edges are substantially contiguous, said extending longitudinal edge of said second member being substantially tangent to said flexible sealing means at a position sufficiently far from either end of said flexible sealing means that upon said members being substantially coplanar, said flexible sealing means biases against said second member longitudinal edge with force resulting form air directed against said members in a direction generally facing said recess.

17. A damper comprising:

a. a frame;

b. blades pivotally mounted in said frame, moveable between a position at which all of said blades are essentially coplanar with adjacent edges of adjacent blades being substantially contiguous, and a position at which said blades are substantially 90 degrees from said previous position with individual blades in planes parallel one with another;

c. means for moving said blades between said two position;

d. at least one of said blades having a longitudinally extending recess proximate but removed from a longitudinally extending blade edge;

e. sealing means secured to the longitudinal edge of said blade having said recess, at a mouth of said recess;

f. a second blade adjacent said first blade having a longitudinal edge extending towards said first blade longitudinal edge when said blades are substantially coplanar, said extending longitudinal edge of said second blade being close to said sealing means so that upon said blades being substantially coplanar, said sealing means sealingly biases against said longitudinal edge of said second blade responsively to air moving in a direction facing said recess.

18. The damper of claim 17 wherein:

a. said sealing means is concave in a direction away from said recess;

b. said recess is generally V-shaped;

c. said transversely extending longitudinal edge of said second blade is the extremity of one leg of a second V-shape, remote from the vertex of the second V, said second V-shape being formed in said blade and facing oppositely from said recess;

d. said extremity of one leg of said second V-shape, remote from the vertex of said second V, defining said transversely longitudinal edge of said second blade is substantially co-planar with a major portion of said second blade.

19. A damper comprising:

a. a frame;

b. a plurality of members mounted in said frame, moveable between an open position and a closed position in which adjacent members are substantially contiguous;

c. a recess in one of said members proximate an edge thereof to which an adjacent member is substantially contiguous when said members are in the closed position;

d. means for closing space between said adjacent members when in said closed position, secured to said member having said recess and extending at least part-way thereacross, by moving against said adjacent member responsively to air flow towards said recess.

20. A damper comprising:

a. a frame;

b. a plurality of members mounted in said frame, moveable between an open position and a closed position in which adjacent members are substantially contiguous;

c. a curved recess in one of said members proximate an edge thereof to which an adjacent member is substantially contiguous when said members are in the closed position;

d. means for closing space between said adjacent members when in said closed position, secured to said member having said recess and extending at least part-way thereacross, by moving against said adjacent member responsively to air flow traveling around the curved recess and moving therefrom against said space closure means.

* * * * *